United States Patent [19]

Pipkin et al.

[11] Patent Number: 4,857,172

[45] Date of Patent: Aug. 15, 1989

[54] HEAVY MEDIUM SEPARATION TRACER ELEMENT

[76] Inventors: Noel J. Pipkin, 138/140 Pritchard Street, Johannesburg North, Randburg, Transvaal; Michael S. Hunt, 52 Ararat Street, Westdene, Johannesburg, Transvaal, both of South Africa

[21] Appl. No.: 133,462

[22] Filed: Dec. 15, 1987

[30] Foreign Application Priority Data

Dec. 19, 1986 [ZA] South Africa ..... 86/9562

[51] Int. Cl.[4] ..... B03B 13/00; B04C 11/00

[52] U.S. Cl. ..... 209/1; 209/172.5; 209/211

[58] Field of Search ..... 209/1, 546, 931, 172, 209/172.5, 211; 252/60, 408.1, 965; 420/540, 541

[56] References Cited

U.S. PATENT DOCUMENTS

| | | | |
|---|---|---|---|
| 2,878,518 | 3/1959 | Klee | 252/60 X |
| 2,904,693 | 9/1959 | Miller et al. | 252/408.1 X |
| 4,345,994 | 8/1982 | Leonard, III et al. | 209/1 |
| 4,713,216 | 12/1987 | Higashi et al. | 420/541 X |

FOREIGN PATENT DOCUMENTS

| | | | |
|---|---|---|---|
| 2061771 | 5/1981 | United Kingdom | 209/931 |

OTHER PUBLICATIONS

"Continuous Measurement of Consistency of Ferrosilicon/Magnetite Suspension in a Drum Type Heavy Media Plant", Laszlo Valentyik, National Sand and Gravel Association (NSGA) Circular No. 106, Apr. 1970.

"A Magnetic Tracer Technique to Determine Partition Coefficients for Gravity Separations", Dr. William Foreman et al, presented at Second Symposium on Coal Preparation, Oct. 1976.

Methods & Machines—Density Tracers Evaluate Gravity Concentration Plant Performance, *Mining Journal,* Aug. 1983, p. 115.

*Primary Examiner*—Robert B. Reeves

*Assistant Examiner*—Edward M. Wacyra

*Attorney, Agent, or Firm*—Beveridge, DeGrandi & Weilacher

[57] ABSTRACT

A tracer element for use in determining the efficiency of a heavy medium separation method which is made of aluminum, an aluminum/zinc alloy or an aluminum/-magnesium alloy.

10 Claims, No Drawings

HEAVY MEDIUM SEPARATION TRACER ELEMENT

BACKGROUND OF THE INVENTION

This invention relates to heavy medium separation.

Heavy medium separation is used extensively to separate diamond particles from gangue. The method generally involves crushing diamond-bearing ore to a predetermined size and making a suspension of the crushed mass with ferro-silicon particles in water. The suspension is pumped into a cyclone to effect separation. The tailings fraction, containing mostly gangue, issues from the top of the cyclone while the heavy fraction, containing most of the heavy minerals and diamond, issues from the bottom of the cyclone. It is difficult to determine the efficiency of the separation and it may well be that in certain cases the tailings contain considerable quantities of diamond, so much so as to justify a further separation step.

To determine the efficiency of a separation process of this type tracer elements are used. The tracer elements may be color coded according to densities. The elements correspond to a plurality of fractions, each fraction being of predetermined quantity and density. The range of densities of the fractions cover the approximate range of densities of the crushed diamond bearing ore, normally in the range of the order from 2.5 to 3.5 grams/cc.

The tracer elements are added to an aqueous suspension of the crushed ore and ferro-silicon particles and thoroughly mixed. The mixture is pumped into the cyclone and separated into a top tailings fraction and a bottom, predominantly diamond-bearing fraction. The proportion of elements of each density reporting in each fraction is then determined by counting or similar procedure and from this data appropriate distribution curves can be drawn and the efficiency of the process determined.

The tracer elements currently used are made of plastic. The plastic has a filler material of varying amounts added prior to it being extruded or otherwise formed into the tracer element. The addition of the filler material to the plastic makes it difficult to extrude the plastic into the desired tracer element.

SUMMARY OF THE INVENTION

According to the present invention, there is provided a tracer element for use in determining the efficiency of a heavy medium separation method as described above which is made of aluminum an aluminum/zinc alloy or aluminum/magnesium alloy.

DETAILED DESCRIPTION OF THE INVENTION

The use of aluminum or an aluminum/zinc or aluminum/magnesium alloy has the advantage that it allows for the production of tracer elements having a number of advantages over the currently used plastic tracer elements. First, tracer elements of accurate and precise densities can be produced. Indeed, tracers having a density within 0.02 g/cm$^3$ of the desired density can be produced. Secondly, the aluminum and the alloys have a uniform density throughout allowing for the production of tracer elements having a similar characteristic. Third, the aluminum and the alloys can be extruded, cast or rolled into any desired shape or configuration.

For the more dense tracer elements (i.e. density greater than 2.7), it is preferred that the aluminum/zinc alloy is used. For the less dense tracer elements (i.e. density less than 2.7), the preferred alloy is the aluminum/magnesium alloy.

The aluminum in the alloys will constitute the major element with the zinc or magnesium preferably being in the range of up to 40% by weight. The tracer elements of the invention may be of any suitable size or shape and will be color coded to distinguish an element of one density from another. Color may be introduced by conventional anodizing methods with the suitable addition of colorizers to the anodizing media.

Examples of typical alloys are:

| Bulk Density of Tracer | Zn Content (wt %) |
|---|---|
| 3.5 | 36.76 |
| 3.3 | 29.24 |
| 3.1 | 20.74 |
| 2.9 | 11.09 |
| 2.7 | 0 |
| | Mg Content (wt %) |
| 2.5 | 14.5 |

We claim:

1. A tracer element for use in determining the efficiency of a heavy medium separation method which is made of a material selected from aluminum, an aluminum/zinc alloy of density greater than about 2.7 grams/cc and containing up to about 40 percent by weight zinc and an aluminum magnesium alloy of density less than about 2.7 grams/cc and containing up to about 40 percent by weight magnesium.

2. A tracer element according to claim 1 which is made of an aluminum/zinc alloy of density up to about 3.5 grams/cc.

3. A tracer element according to claim 1 which is made of an aluminum/magnesium alloy of density down to about 2.5 grams/cc.

4. A plurality of tracer elements for use in determining the efficiency of a heavy medium separation method which tracer elements have densities in the approximate range of densities of crushed diamond-bearing ores and which correspond to a plurality of fractions, each fraction being of predetermined density, and the tracer elements are made of aluminum, aluminum/zinc alloy of density greater than about 2.7 grams/cc and containing up to 40 percent by weight zinc and aluminum/magnesium alloy of density less than about 2.7 grams/cc and containing up to 40 percent by weight magnesium.

5. A plurality of tracer elements as claimed in claim 4, in which the range of densities is in a desired density range from about 2.5 to about 3.5 grams/cc.

6. A plurality of tracer elements as claimed in claim 5, each of which is color coded according to its density to distinguish it from another tracer element of another density within the desired density range.

7. A plurality of tracer elements as claimed in claim 6, in which color is introduced by conventional anodizing methods with a suitable addition of colorizer to the anodizing media.

8. A plurality of tracer elements as claimed in claim 5, wherein each tracer element is of uniform, accurate and precise density within 0.02 grams/cc of its desired density.

9. In a conventional heavy medium separation process in which tracer elements are added to an aqueous suspension of crushed diamond-bearing ore plus heavy medium comprising ferro-silicon particles and thoroughly mixed, the mixture is pumped into a cyclone and separated into a top tailings fraction and a bottom, predominantly diamond-bearing fraction, the improvement wherein a plurality of tracer elements as claimed in claim 9 is added to the suspension whereby the proportion of elements of each density reporting in each fraction is determined by counting or similar procedure and from this data appropriate distribution curves can be drawn enabling determination of the efficiency of the process.

10. In a conventional heavy medium separation process in which tracer elements are added to an aqueous suspension of crushed diamond-bearing ore plus heavy medium comprising ferro-silicon particles and thoroughly mixed, the mixture is pumped into a cyclone and separated into a top tailings fraction and a bottom, predominantly diamond-bearing fraction, the improvement wherein a plurality of tracer elements as claimed in claim 4 is added to the suspension whereby the proportion of elements of each density reporting in each fraction is determined by counting or similar procedure and from the data appropriate distribution curves can be drawn enabling determination of the efficiency of the process.

* * * * *